US005431145A

United States Patent [19]

Strait et al.

[11] Patent Number: 5,431,145

[45] Date of Patent: Jul. 11, 1995

[54] METHOD AND APPARATUS FOR PITCHING AN OBJECT

[76] Inventors: Renus D. Strait, Rte. 2, Box 217-A, Columbus, Nebr. 68601; Morgan R. Sharp, 529 E. First St., Newton, Kans. 67114

[21] Appl. No.: 118,951

[22] Filed: Sep. 9, 1993

[51] Int. Cl.[6] ..... A63B 69/00

[52] U.S. Cl. ..... 124/17; 124/20.1; 124/31; 273/26 D

[58] Field of Search ..... 124/16, 17, 20.1, 25, 124/31; 273/26 D, 26 R

[56] References Cited

U.S. PATENT DOCUMENTS

| | | | |
|---|---|---|---|
| 273,510 | 3/1883 | Goldey . | |
| 300,415 | 6/1884 | Van Allen . | |
| 440,538 | 11/1890 | Burton . | |
| 707,000 | 8/1902 | Pease . | |
| 1,237,625 | 8/1917 | Ferguson | 124/16 |
| 2,018,880 | 10/1935 | Woodhead . | |
| 2,267,163 | 12/1941 | Moser | 124/17 |
| 2,282,315 | 5/1942 | Adams | 124/17 |
| 3,277,878 | 10/1966 | Pankratz . | |
| 3,802,409 | 4/1974 | Mike et al. . | |
| 3,857,379 | 12/1974 | Burghardt . | |
| 4,593,673 | 6/1986 | Kees . | |

FOREIGN PATENT DOCUMENTS

| | | | |
|---|---|---|---|
| 890057 | 1/1944 | France . | |
| 665518 | 1/1952 | United Kingdom | 124/17 |

*Primary Examiner*—Eric K. Nicholson
*Assistant Examiner*—Anthony Knight

[57] ABSTRACT

A slingshot-type ball pitching apparatus includes an elongated frame having a fork and trigger mechanism vertically adjustably supported at opposite front and rear ends thereof. A ball-carrying pouch is connected by stretchable tension members to the fork and may be pulled rearwardly to secure the ball within the set trigger mechanism. Upon release by the trigger mechanism, the ball is propelled forwardly from the apparatus. The trigger mechanism is preferably adjustable both vertically and transversely relative to the frame.

20 Claims, 5 Drawing Sheets

METHOD AND APPARATUS FOR PITCHING AN OBJECT

FIELD OF THE INVENTION

The present invention is directed generally to a slingshot-type ball pitching apparatus. More specifically, the present invention relates to a ground-supported apparatus capable of varying both a speed of pitched balls as well as a vertical and a transverse direction of a ball pitched therefrom.

BACKGROUND OF THE INVENTION

A patentability investigation was conducted and the following United States patents by numbers were discovered: U.S. Pat. Nos. 3,277,878 to Pankratz; 300,415 to Van Allen; 3,802,409 to Mike et al; 707,000 to Pease; 4,593,673 to Kees; 440,538 to Bruton; and 2,018,880 to Woodhead. None of the foregoing prior art U.S. patents teach or suggest the specific apparatus and/or method of the present invention.

Commercially available automatic pitching machines generally are of two types. The first is a very heavy machine having a mechanical arm which actually throws a baseball. This type of machine is often only found in batting cages in urban areas, is not readily transportable and is very expensive. The other type of pitching machine used by ball teams includes a pair of rotating wheels with balls individually placed between the wheels and thereby propelled toward a batter. These devices are also very expensive and damage conventional baseballs rather easily.

Pankratz U.S. Pat. No. 3,277,878 discloses a baseball throwing machine in the form of a table supported catapult with limited adjustability. Whereas the front end of the ball propelling device is height adjustable, the apparatus itself affords no transverse adjustability of the direction of a pitched ball and the position from which the ball is thrown is not vertically adjustable. Accordingly, a primary object of the invention is to provide an improved slingshot-type of ball pitching apparatus.

Another object is to provide such a pitching apparatus including a stationary ground-supported frame.

Another object is to provide such a pitching apparatus including a longitudinally spaced apart fork and ball release trigger mechanism which are both independently vertically adjustable relative to the frame.

Another object is to provide such a pitching apparatus wherein at least one or the other of the fork and trigger mechanism are transversely adjustable relative to the frame for varying the transverse direction of a pitched ball.

Another object is to provide such a pitching apparatus having a frame adapted to be releasably anchored to the ground.

Another object of the invention is to provide such a pitching apparatus having a trigger mechanism which enables limited vertical adjustment of the position of the ball within the trigger mechanism for varying the direction or movement of a pitched ball.

Finally, an object of the invention is to provide an improved slingshot-type pitching apparatus which is simple and rugged in construction, economical to manufacture and efficient in operation.

SUMMARY OF THE INVENTION

The present invention accomplishes its desired objects by broadly providing a slingshot-type ball pitching apparatus which includes an elongated ground-supported frame having an upright fork mounted adjacent the forward end of the frame and a trigger mechanism mounted at an elevated position adjacent the rearward end of the frame. A ball-receiving pouch is connected by a stretchable tension member to the fork and may be pulled rearwardly against the forward bias of the tension member for engagement by the trigger mechanism. The fork and/or trigger mechanism are length adjustably supported relative to the frame for varying the release speed of the ball. Likewise, the fork and/or trigger mechanism are transversely adjustable relative to the frame for transverse adjustment of the direction of a ball released by the trigger mechanism.

The fork and trigger mechanism are also preferably each independently vertically adjustable relative to the frame by respective telescoping tube structures. The frame may include an elongated main tube having a second tube telescopically slidably supported thereon with the telescoping tube structure of either the fork or trigger mechanism mounted on the second tube for longitudinal movement therewith. By rotating the second tube about the main tube, transverse adjustment of the direction of the pitched ball is accomplished.

The trigger mechanism includes a pair of ball retention arms having free ends movable toward and away from one another, biasing devices urging the free ends away from one another and a trigger movable between working and release positions and engageable with the ball retention arms in the working position thereof to secure the free ends of the arms in adjacent relation against the urging of the biasing devices for releasably holding a ball in the pouch therebetween. The trigger is downwardly spring biased so as to easily engage the ball retention arms. The free ends of the ball retention arms terminate in upright ball retention members which permit limited vertical adjustment of the ball within the trigger for limited vertical variance of the direction and movement of a ball released by the trigger mechanism. A coupling member secures the elongated tube to the second tube. The coupling member varies in length to correspondingly vary a distance and/or speed of the ball pitched by the apparatus. A lobbing attachment is provided for variably adjustably elevating the forward end of the apparatus thereby creating an angular disposition of the apparatus for increasing the arc of travel or trajectory of the ball pitched thereby. It is further an object of the present invention to provide a method for throwing or pitching an object, such as a baseball, comprising the steps of:

(a) providing a slingshot-type pitching apparatus comprising an elongated ground support frame having forward and rearward ends thereof, an upright fork, the fork having a space between two bifurcated members thereof of greater than one foot, a fork mounting means for mounting the fork adjacent the forward end of the frame, an object-receiving pouch, a stretchable tension member connecting the pouch to the fork, a trigger mechanism, a trigger mounting means for mounting the trigger mechanism at an elevated position adjacent the rearward end of the frame, the trigger mechanism being spring biased and operative to releasably hold an object upon placement of the object in the pouch and upon stretching of the tension member to pull the pouch and the object contained therein rearwardly for engagement by the trigger mechanism, a length adjusting means for length adjustably supporting at least one of the fork and trigger mechanism on the frame thereby to vary the release speed of the ball, a transverse adjusting means for adjusting a transverse position of at least one of the fork and the trigger mechanisms relative to the frame thereby to transversely adjust the direction of a ball released by the trigger mechanism, a frame adjusting means for adjusting a distance between the fork and the trigger mechanism, a lobbing mechanism for angularly situating the apparatus such that the apparatus may variably alter the arc of the ball to be pitched, means for mounting the lobbing mechanism to the forward end of the frame, and means for adjustably varying a vertical length of the lobbing mechanism;

(b) installing the apparatus on a surface;

(c) placing an object in the pouch;

(d) stretching the pouch and the object contained therein rearward;

(e) engaging the pouch and the object contained therein with the trigger mechanism;

(f) adjusting the transverse adjustment with the transverse adjusting means, the frame adjustment with the frame adjusting means, and the length adjustment with the length adjusting means;

(g) adjusting the lobbing adjustment with the lobbing adjusting means; and (h) releasing the trigger mechanism to throw the object.

These, together with the various ancillary objects and features which will become apparent to those skilled in the art as the following description proceeds, are attained by this novel apparatus and method, a preferred embodiment as shown with reference to the accompanying drawings, by way of example only.

DETAILED DESCRIPTION OF THE INVENTION

Figure 3:
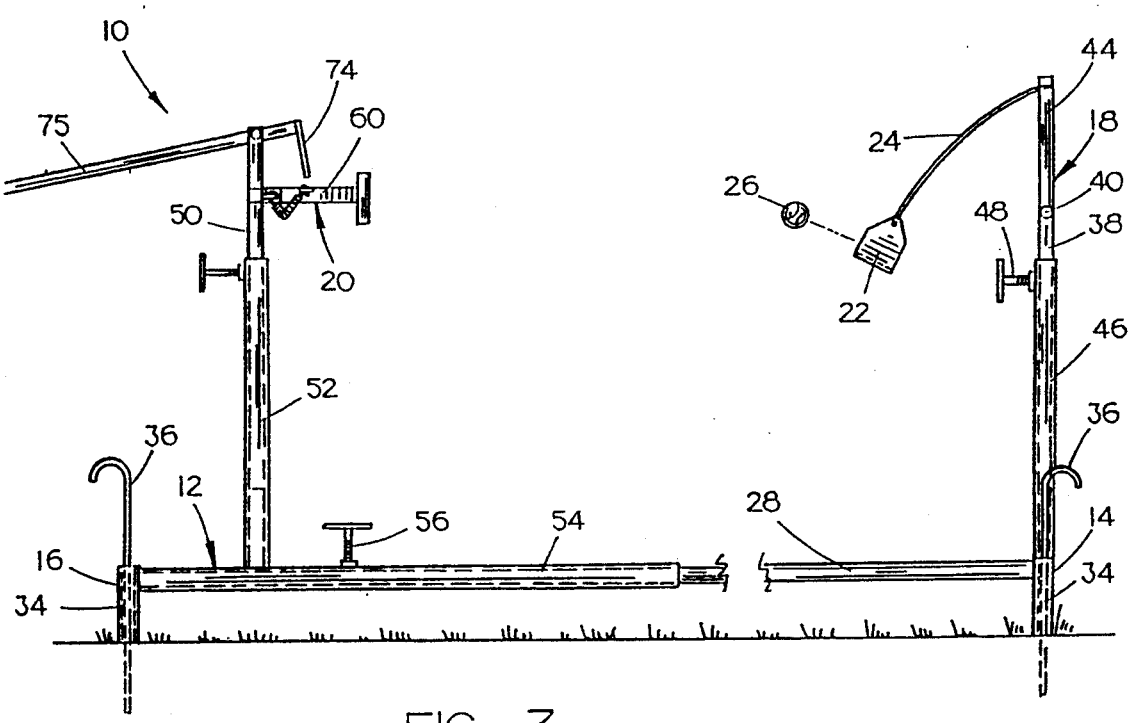
FIG. 3 is a foreshortened side elevational view of the apparatus in an unloaded relaxed state.
Figure 4:
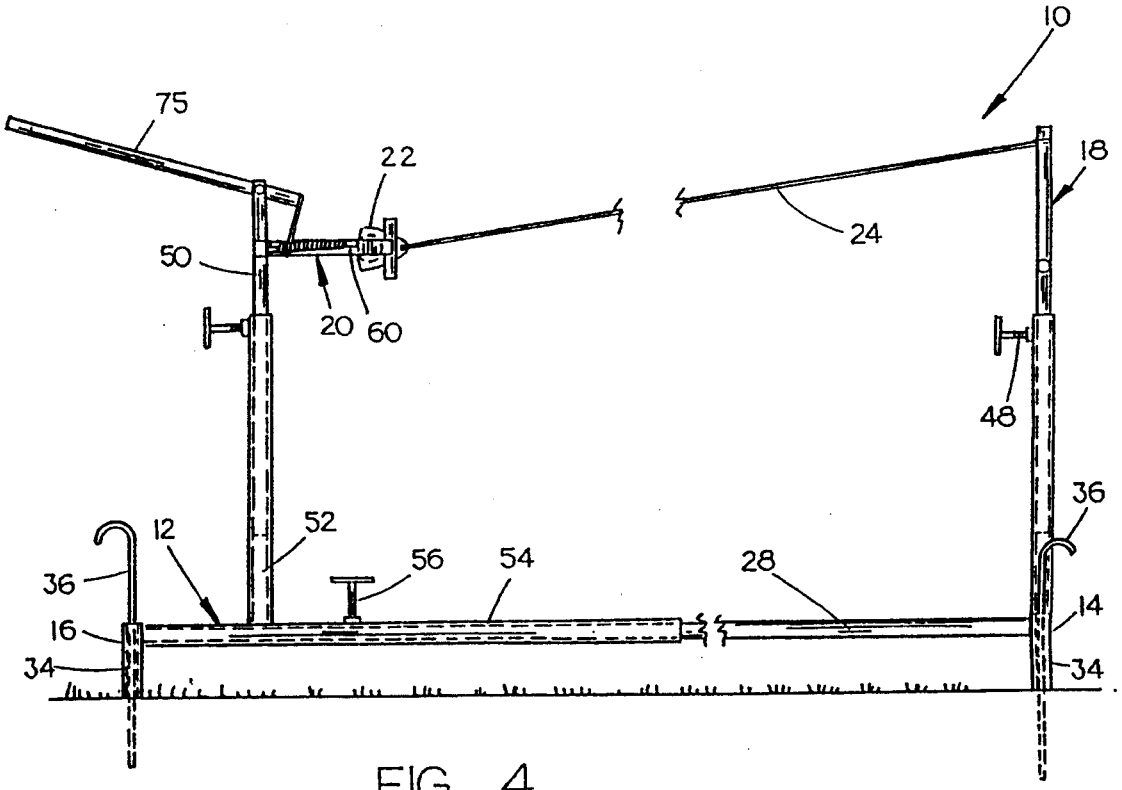
FIG. 4 is a foreshortened side elevational view of the apparatus with the surgical tubing outstretched and the ball secured within the pouch in the set trigger mechanism.

The slingshot-type ball pitching apparatus 10 of the present invention is shown in FIGS. 3 and 4 as including an elongated ground-supported frame 12 having forward and rearward ends 14 and 16. An upright fork 18 is mounted on the frame adjacent the forward end and a trigger mechanism 20 is mounted at an elevated position adjacent the rearward end of the frame. A ball-receiving pouch 22 is connected by stretchable tension members 24 to the fork 18 such that a ball 26 may be placed in the pouch and the pouch may be pulled rearwardly stretching the tension members for releasable engagement of the ball and pouch by the trigger mechanism 20 as shown in FIG. 4. Upon release of the trigger mechanism 20, the ball is propelled forwardly from the apparatus toward a batter or catcher for practicing baseball, softball or the like.

Figure 7:
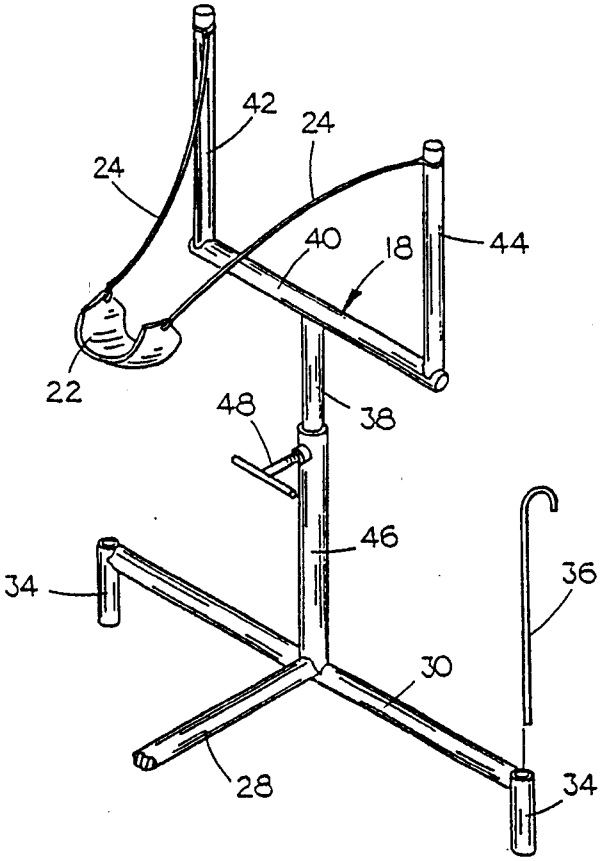
FIG. 7 is a partial foreshortened perspective view of the fork end of the apparatus.

Frame 12 is generally I-shaped including an elongated main tube 28 connected at its opposite ends to front and rear crossbars 30 and 32. The opposite ends of each crossbar are connected to respective upright support tubes 34 through which ground stakes 36 may be inserted into the ground for securely anchoring the frame. In FIG. 7, it is seen that the fork 18 includes a support post 38 which carries a crossbar 40 having a pair of upstanding spaced apart arms 42 and 44. Tension members in the form of elongated lengths of latex surgical tubing 24 connect upper ends of the arms to opposite ends of pouch 22 which may simply consist of a strip of leather having holes in the opposite ends. The fork post 38 is telescopically received within an upstanding fork support tube 46 mounted on the forward end of the frame 12. The fork 18 is thereby vertically adjustable within support tube 46 and may be secured in selected vertical positions by tightening set screw 48 which is threaded through an upper portion of the fork support tube 46.

The trigger mechanism 20 is similarly carried on an upright post 50 which is telescopically received within a rear support tube 52 having a setscrew threaded through an upper end thereof for releasably fixing the vertical position of the trigger mechanism 20. Note that the rearward support tube 52 is connected at its lower end to a second tube 54 which is rotatable about and slidable along main tube 28. A setscrew 56 is threaded through second tube 54 for engaging main tube 28 to releasably set both the rotational and longitudinal positions of the rearward support tube 52 relative to the frame.

Trigger mechanism 20 includes a transverse crossbar 58 having a pair of ball retention arms 60 and 62 pivotally connected thereto at spaced apart locations by hinges 64. The free ends of ball retention arms 60 are reinforced by gussets 66 and terminate in upright ball retention tubes 68 and 70 which enable the ball 26 to be vertically adjusted to a limited extent within the trigger mechanism 20 for limited vertical variance of the direction of a ball released by the trigger mechanism 20. A pair of springs 72 are connected to and extended between a respective ball retention arm and a respective end of crossbar 58 for biasing the ball retention arms apart.

Figure 1:
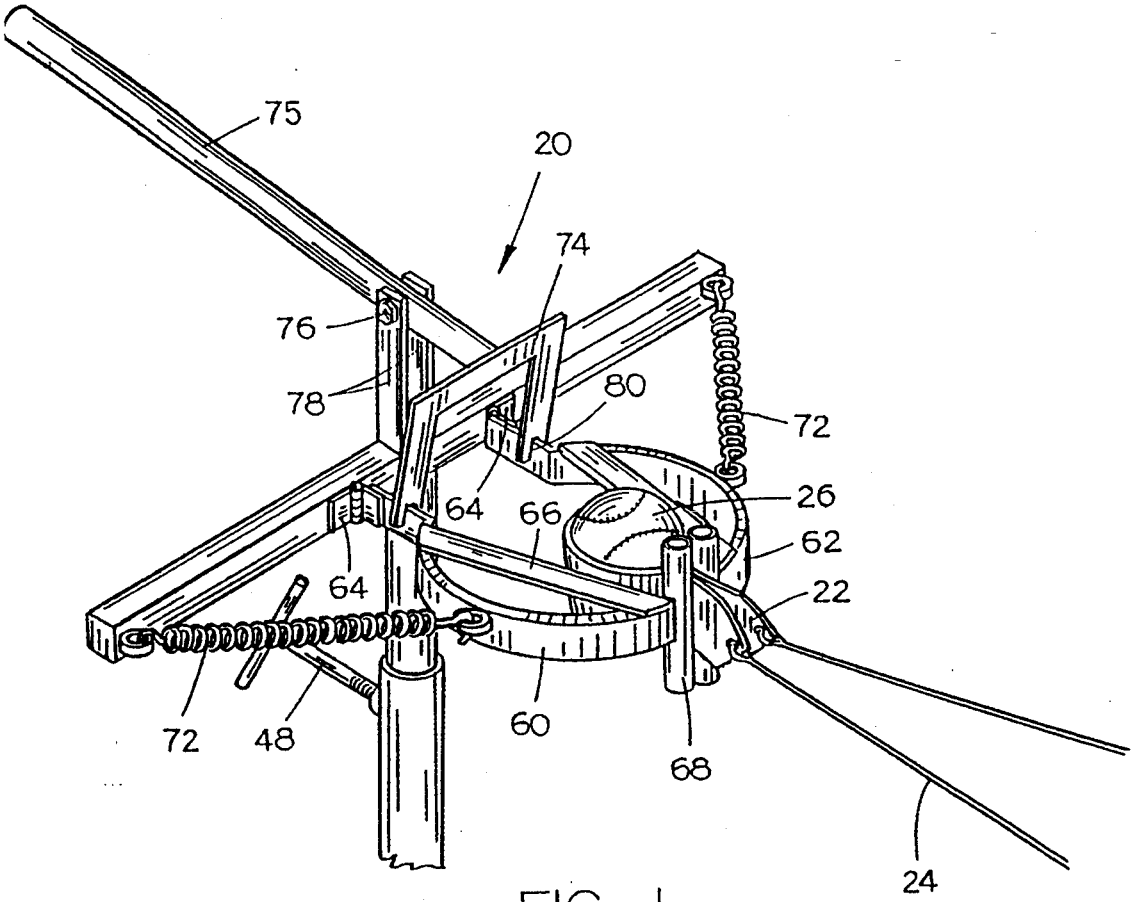
FIG. 1 is a perspective view of the trigger mechanism for holding and automatically releasing a ball in the apparatus.
Figure 2:
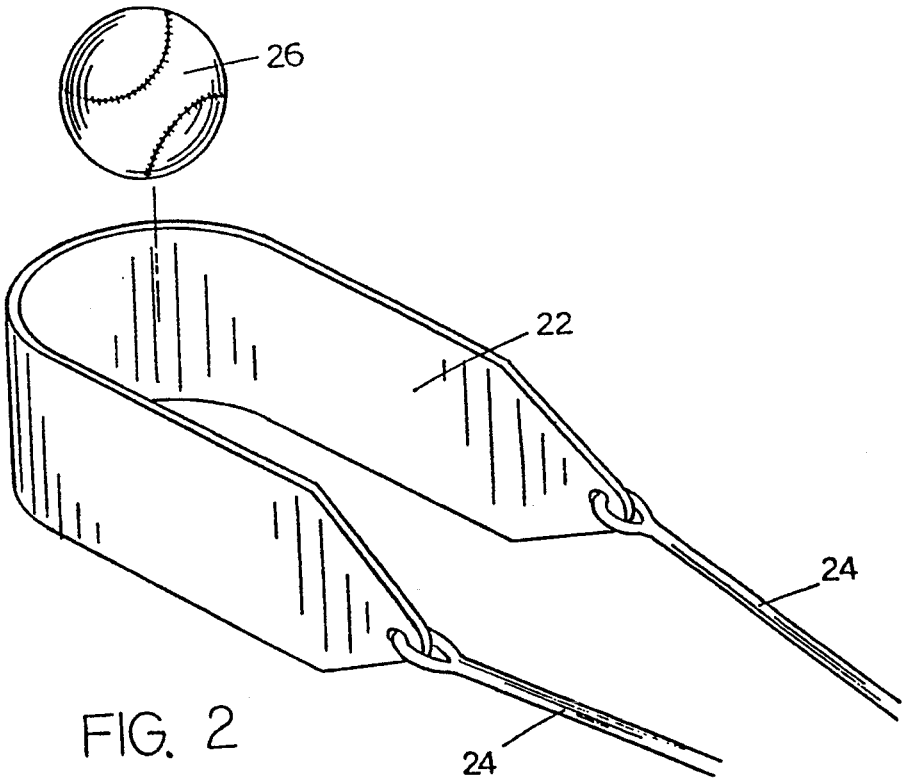
FIG. 2 is an enlarged perspective view of the leather pouch for receiving the ball and holding it in the trigger mechanism.
Figure 6:
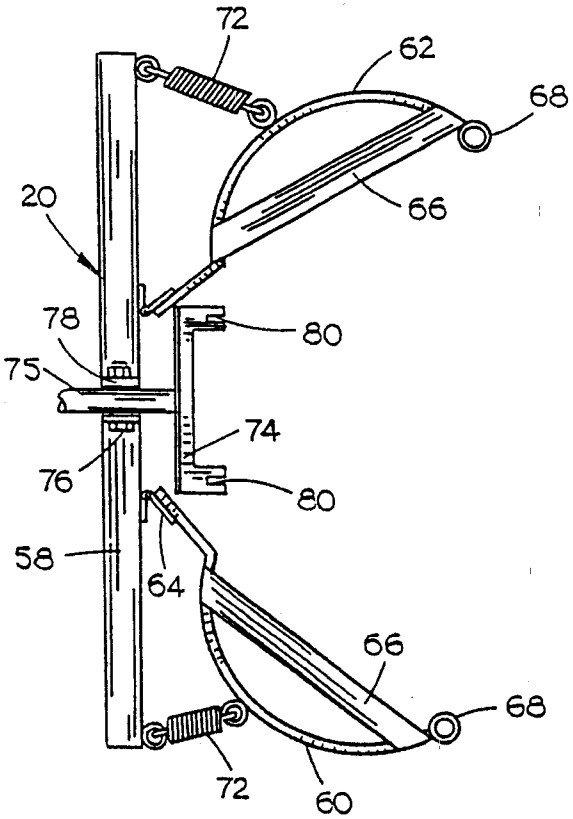
FIG. 6 is a partial top plan view of the trigger mechanism upon release of a ball.
Figure 5:
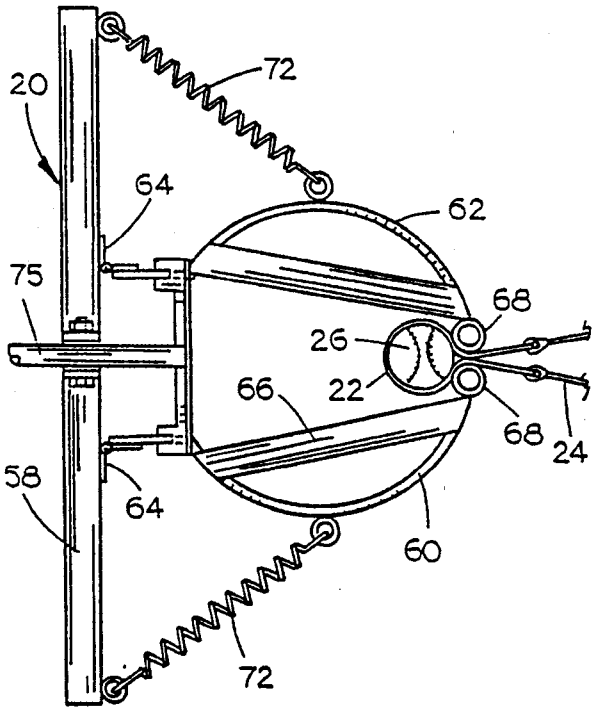
FIG. 5 is a partial top plan view of the set trigger mechanism.

To set the trigger mechanism 20, a ball 26 and pouch 22 are inserted between the ball retention arms which are then closed together against the urging of springs 72-72. The ball retention arms 60 and 62 are secured in the set position by a trigger 74 in the form of an inverted U-shaped member centrally mounted on the end of a trigger handle 75 pivotally supported on a bolt 76 extended between a pair of upright trigger support ears 78. The U-shaped trigger has two depending legs with open bottomed slots 80 for receiving the ball retention arms 60 and 62 as illustrated in FIG. 1. Upon downward movement of the rearward end of handle 75 in the direction of arrow 82 in FIG. 1, the trigger 74 is raised out of engagement with the ball retention arms 60 and 62 which are therefore snapped apart by springs 72, allowing the stretched out surgical tubing 24 to propel the ball and pouch 22 forwardly from the apparatus 10. The set and release positions of the trigger mechanism 20 generally are shown in FIGS. 5 and 6 and the release and working positions of the trigger 74 itself are shown in FIGS. 3 and 4. Whereas the pitching apparatus of this embodiment of the invention has been shown and described in connection with a preferred embodiment thereof, it is apparent that many modifications,, additions and substitutions may be made, such as the following alternative embodiment. Because the ball retention arms 60 and 62 are oversize relative to a baseball, the apparatus is likewise operative for pitching softballs, rubber balls or any other balls that will fit into the pouch.

In operation, the apparatus can be easily transported to a ball field in a broken down condition with the fork and trigger mechanism removed from their respective support tubes. The frame is positioned at the desired distance from a home plate and is oriented with the main frame tube aligned with the center of home plate. The frame is then securely anchored to the ground with stakes 36. The fork and trigger mechanism are then installed and vertically adjusted to accommodate the strike zone of the particular size of batters who are to be pitched to. The apparatus of the invention is inherently safe since it requires no electric or gas motors nor any electric cords. It is so simple to operate that even mothers unfamiliar with it can quickly catch on and use it to pitch to their children. The pouch can be pulled back with two hands to stretch the surgical tubing sufficiently that a ball can likely be pitched with the apparatus faster than it could otherwise be thrown by the operator. A particular advantage of the pitching apparatus of the invention is that the pitches are accurate once the apparatus is adjusted, but they are not uniform. The apparatus typically throws four strikes out of five pitches but those four strikes are likely to be at different positions in the strike zone. The vertical adjustability of the pouch within the trigger mechanism accounts for some of the variance. The apparatus also tends to throw a few knuckle balls so the batter can expect a wide variety of pitches. Finally, the narrow profile of the apparatus when viewed from the front makes the apparatus a very small target which will be seldom hit by batted balls. Thus, there has been shown and described an improved slingshot-type ball pitching apparatus which accomplishes at least all of the stated objects.

Figure 8:
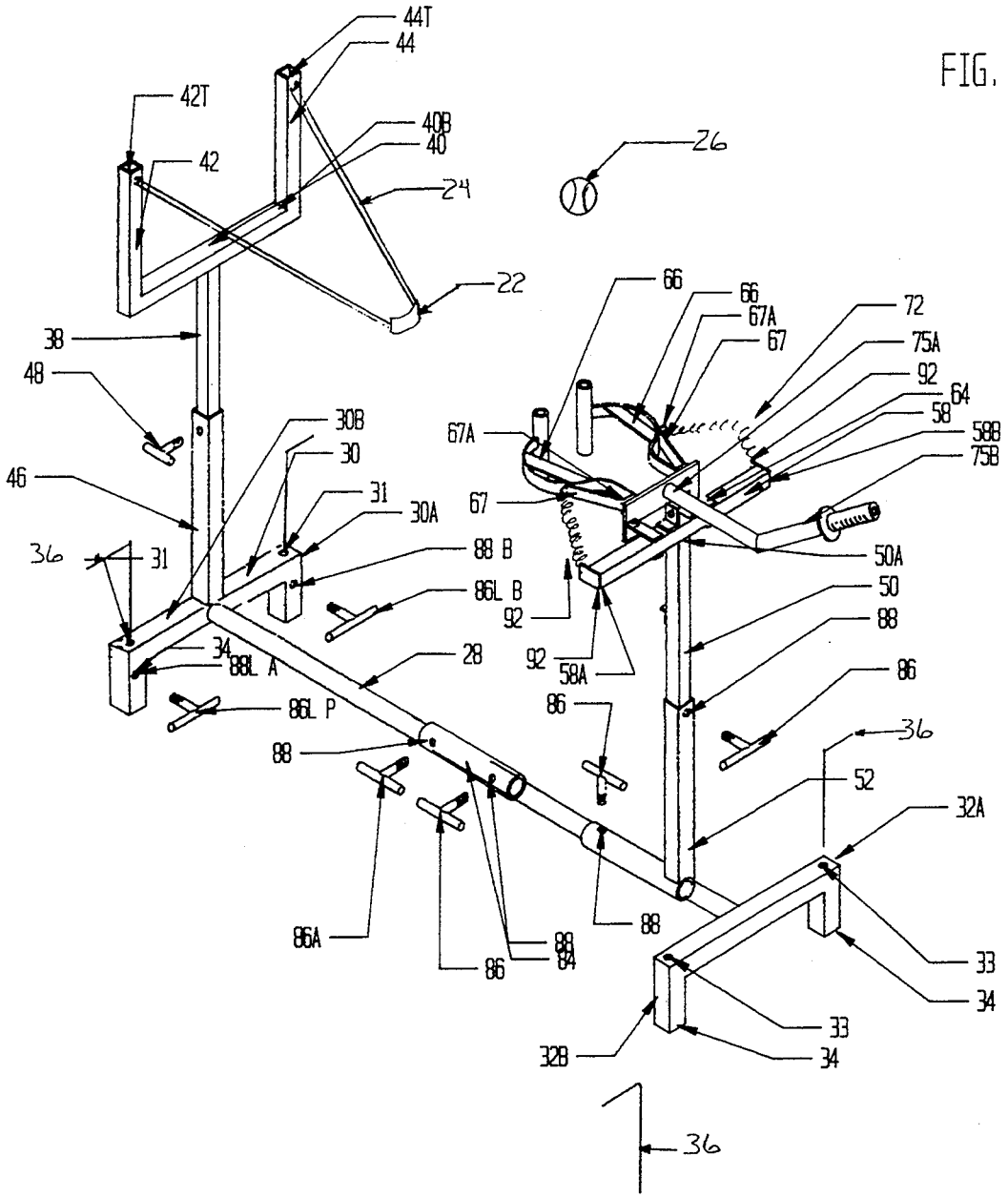
FIG. 8 is a perspective view of another embodiment of the pitching apparatus of the invention.
Figure 9A:
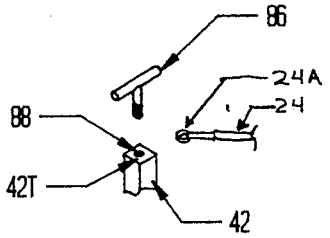
FIG. 9A is a partial perspective view of one embodiment of an upright end of a fork member of the invention.
Figure 9C:
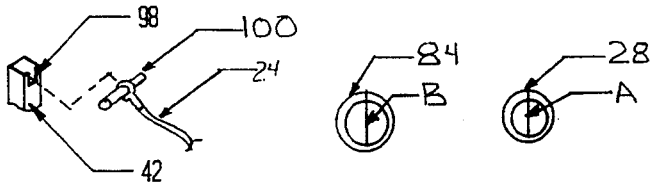
FIG. 9C is a cross sectional view of a pair of frame tube members and a coupling member disclosing diameters thereof.
Figure 9B:
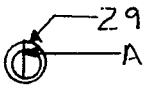
FIG. 9B is a partial perspective view of another embodiment of an upright end of the fork of the invention.
Figures 10, 11:
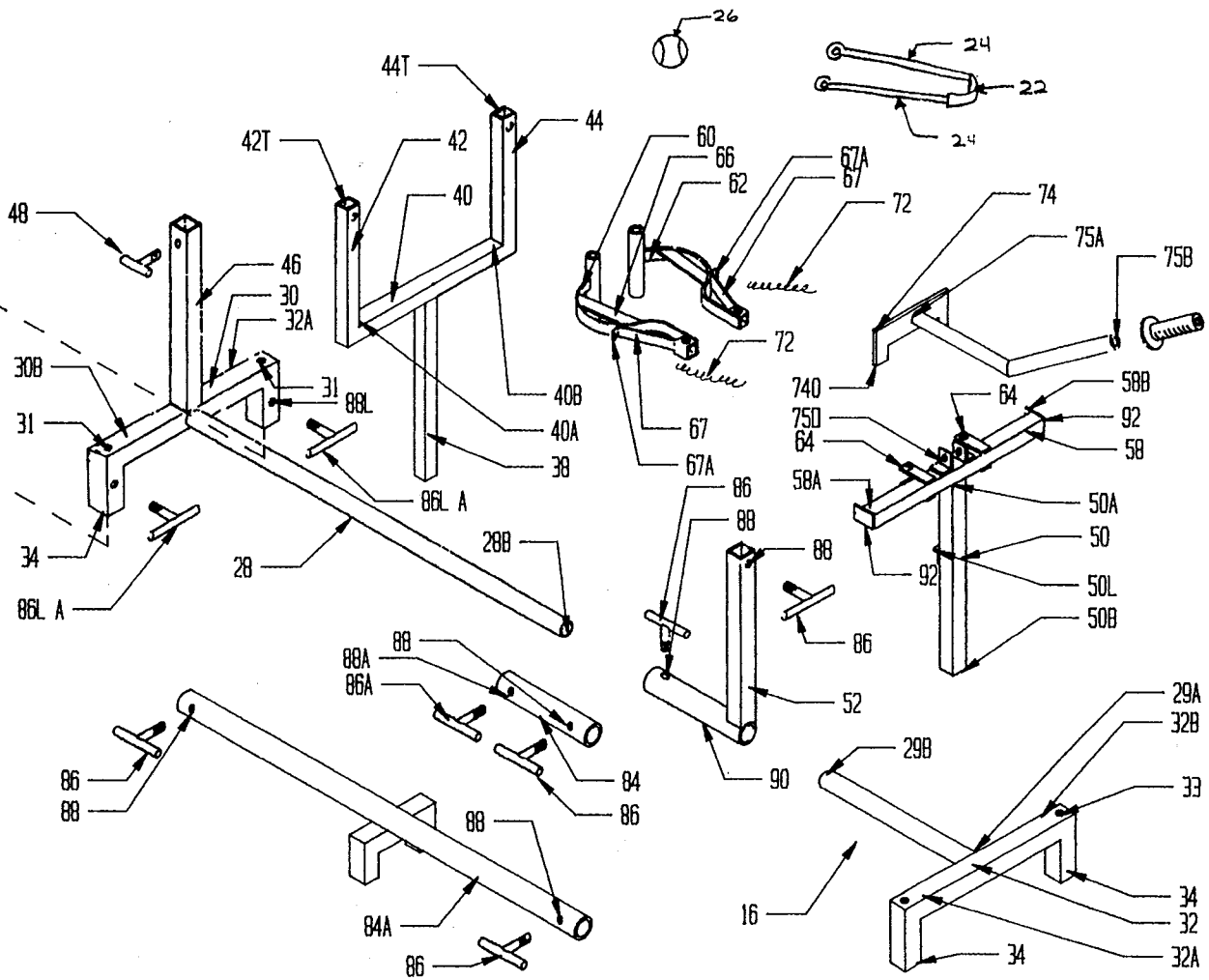
FIG. 10 is segmented view of the pitching apparatus of the invention.
FIG. 11 is a perspective view of a lobbing mechanism therefor.

Referring now to FIGS. 8–10 another embodiment of the apparatus 10 is disclosed. The pitching apparatus 10 of this embodiment comprises the frame 12 having ends 14 & 16 thereof, the fork 18 and the trigger mechanism 20. The pitching apparatus 10 of this embodiment also comprises the ball retention members or arms 60-62, the ball receiving pouch 22, and the tension members 24-24. As in the previous embodiment, the frame 12 comprises the elongated tube member 28, preferably cylindrical in shape, having one end 28A thereof secured to the front crossbar 30. Another tube member 29, generally cylindrical in shape, has an end 29B coupled to the end 28B of the elongated tube member 28 by a coupling member 84. The coupling member 84 is generally cylindrical in shape and comprises an inner diameter that is such to allow the elongated tube member 28 and the tube member 29 to be slidably received thereby. Stated alternatively, the elongated tube member 28 and the tube member 29 both comprise an outer diameter A (see FIG. 9C) that is generally equivalent. The coupling member 84 comprises an inner diameter B that is slightly larger than the diameter A of the tube member 28-29 such that the tube members 28-29 may be slidably received by the coupling member 84 and removably engaged thereto by setscrews 86-86 (see FIG. 8). The coupling member 84 comprises at least two threaded apertures 88-88 for threadably receiving the setscrews 86-86. Another end 29A of the tube member 29 is secured to the rear crossbar 32. Rear cross bar 32 has a pair of tube members 34-34 secured to opposed ends 32A–32B of the rear crossbar 32 so as to be perpendicular thereto. The rear crossbar 32 has a pair of apertures 33-33 disposed therein which are generally aligned with the internal cavities of the tube members 34-34 for slidably receiving a stake member 36 or a bolt member 37 passing therethrough for securing the apparatus 10 to the ground. Similarly, the elongated tube member 28 has end 28A secured to the front crossbar member 30. The front crossbar member 30 comprises a pair of opposed ends **30*a*–30*b* whereto another pair of tube members 34-34 are secured. In this embodiment the tubes 34-34-34-34 secured to the front crossbar 30 and the rear crossbar 32 are preferably generally rectangular or square in cross section. Front crossbar 30 has a pair of apertures 31-31 disposed therein which are generally aligned with the internal cavities of the tube members 34-34 for slidably receiving the stake members 36-36 or the bolt members 37-37. The fork support tube 46, as in the previous embodiment, is secured to the front crossbar member 30 for slidably receiving the fork 18 in a telescopic fashion. The fork member comprises the crossbar member 40 having a pair of opposed ends 40*a*–40*b* thereof secured to the pair of bifurcated upright spaced-apart arm members 42-44. In this embodiment, it has been found that greater accuracy of the pitched ball is achieved when the distance between the spaced-apart arm members 42-44 is generally greater than about 12 inches. Thus in a preferred embodiment of the fork 12, the spaced-apart arm members 42-44 preferably comprise a distance therebetween of from about 12 inches to about 16 inches. The tension members 24-24 are coupled to the arm members 42-44 by any suitable means. Given by way of example only, as shown in FIG. 9A, the tension members 24-24 may comprise an end 24a having a structure defining a ring-shaped loop which is engaged by another setscrew 86 threadably engaged to another aperture 88 disposed in a pair of respective top ends 42*t*–44*t* of the spaced apart arms 42-44. Alternatively, as shown in FIG. 9B, the end 24*a* of the tension member 24 may be engaged by a bolt member 100, dowel member, or the like and disposed in a notch 98 formed in the ends of the spaced apart arms 42-44. Any suitable state of the art means of attaching tension members 24-24 to the fork 18** is understood and intended for the scope of the invention.

The coupling member 84 may comprise a variety of lengths such as, given by way of example only, from about 4 inches to about 40 inches, such that the distance between the fork 18 and the trigger mechanism 20 may be varied to accordingly decrease or increase the speed of an object hurled by the pitching apparatus 10. This is a salient feature of the invention. As shown in FIG. 10, the coupling member 84*a*, given by example only, may comprise a length equivalent to the elongated tube member 28 for increasing the tension placed upon the tension members 24-24 when the ball 26 and the pouch 22 are engaged by the ball retention arms 60-62. The rear support tube member 52 in this embodiment defines a structure that is generally square in cross section. The rear support tube member 52 comprises another threaded aperture 88 for threadably receiving another setscrew 86 thereby. A short tube member 90 is secured generally perpendicular to the rear support tube member for being slidably engaged to the tube member 29 of the frame 12. Short tube member 90 comprises another threaded aperture 88 for threadably receiving another setscrew 86 for fixing the short tube member 90 at a given point along the tube member 29. The short tube member 90 comprises an inner diameter that is generally equivalent to the inner diameter B of the coupling member 84, such that the short tube member 90 may slide along the tube member 29 to provide additional adjustment of the distance between the upright 50 that is telescopically and slidably received by the rear support tube member 52, and the fork 18. Such additional adjustment is desirable, as it allows the speed of a pitched ball 26 or object to be varied after the length of the combination of the elongated tube member 28, the coupling member 84 and the tube member 29 has been fixed and/or after the pitching apparatus 10 has been fixed to the ground. The transverse crossbar 58 is secured to an end 50*a* of the upright member 50. Another end 50B of the upright member 50, as previously indicated, is telescopically arranged so as to be coupled to or slidably disposed in the rear support tube 52 and fixed thereto by the setscrew 86 threadably disposed in aperture 88.

The transverse crossbar 58 comprises a pair of lip members 92-92 secured to opposed ends 58*a*–58*b* of the transverse crossbar 58 for engaging one end of each of the spring members 72-72. The other end of each of the spring members 72-72 is coupled to the respective ball retention members 60-62. The ball retention members 60-62 in this embodiment are essentially the same, with the addition of a pair of support members 67-67 added to an outside edge of each of the ball retention arms 60-62 for providing additional transverse support in addition to the gussets 66-66 thereof. The support members 67-67 each comprise an aperture 67*a* disposed therein for engaging the spring members 72-72 for springably biasing the ball retention arms 60-62 away from each other, or such that the ball retention arms 60-62 tend to rest (i.e. decreasing spring bias acting thereon) in an open position. The spring bias eases the loading or cocking process of disposing the ball/pouch combination 22/26 therein and facilitates the release of the ball/pouch combination 22/26 when the ball retention arms 60-62 are released by the trigger mechanism 20. As the ball retention arms 60-62 are released by the trigger mechanism 20, the ball retention arms 60-62 spring outward such that the trajectory of the ball-/pouch combination 22/26 is unaffected thereby. The springs 72-72 therefore enhance the accuracy of the apparatus 10. The trigger mechanism 20 is also slightly revised in the embodiment depicted by FIGS. 8–10. The trigger handle 75 has a pair of opposed ends 75*a*–75*b* thereof and an aperture 75*o* disposed therein for pivotally securing same to the transverse crossbar. End 75*a* has the trigger member 74 secured thereto for releasably engaging the ball retention members 60-62. The trigger member 74 comprises a structure that is generally defined by an inverted U-shape. The ball retention arm members 60-62 are retained against the bias of springs 72-72 secured thereto by inside edges 74A—74A of the trigger member 74. End 75B is angularly disposed relative to end 75A of the trigger handle. Preferably, an angle C relative to end 75A of end 75B measures from about 90–170 degrees (i.e. handle 75, from end 75A to end 75B is generally not straight such that angle C would measure 180 degrees). The angular disposition of the handle 75 enables easier operation thereof or access thereto, as the height of the apparatus at the rear end would otherwise cause an adult operator to stoop to reach handle 75. Another spring member 72T is secured to the trigger member 74 to cause the trigger mechanism to be spring biased. A lip member 50L is secured to the upright post 50 for engaging one end of spring 72T and an aperture 74*o* is disposed in the trigger mechanism for engaging another end of spring 72T. The bias of the trigger mechanism 20 is such that the trigger member 74 is downwardly biased and/or such that handle 75, pivotally opposed thereto, is upwardly biased. Such spring bias further facilitates the cocking or locking process of the ball retention arms 60-62 in the inverted U-shape of the trigger member 74 (i.e. inside edges 74A—74A). As the ball retention arms 60-62 are moved inwardly or towards each other, the trigger member 74 "snaps" or moves downwardly such that inside edges 74A—74A engaged the outer supports 67—67 of the respective ball retention arm members 60-62.

This embodiment of the apparatus 10, as best shown in FIG. 11 further comprises a lobbing mechanism 110 for modifying the arc of travel or trajectory (e.g. for throwing fly balls) of a pitched ball 26. The lobbing mechanism 110 comprises a first generally rectangular or square stanchion or tube member 112 vertically disposed and secured to a generally horizontal base bar member 120. The base bar member 120 has a pair of opposed ends 120A–120B thereof forming or having secured thereto a pair of foot members 118-118. The foot members 118-118 each form a spiked end 118*s*—118*s* thereof for securing the foot members 118-118 to the ground. It may be appreciated that the foot members 118-118 may terminate in a rubber foot member 118*r*–118*r*, or the like, for use in a gymnasium or similar indoor facility. A second generally square or rectangular tube member 114 having a pair of opposed ends 114A–114B thereof is telescopically and/or slidably disposed in the first tube members 112 and fixed thereto with another setscrew/aperture combination 86/88. The first tube member 112 comprises the aperture 88F disposed therein for threadably receiving the setscrew 86F. End 114A of the second tube member 114 is telescopically and/or slidably disposed in the first tube member 112 and setscrew 86 is threadably engaged to aperture 88 so as to fix the second tube member 114 to the first tube member 112. End 114B of the second tube member terminates in a horizontally disposed cylindrical tube member 126. A generally cylindrical transverse bar member 122 having a pair of opposed ends 122A–122B thereof is slidably disposed in the tube member 126 such that the transverse bar member 122 is free to rotate or swivel therein. End 122A passes through the tube member 126 and an upright generally square or rectangular foot engaging member 124A is secured thereto. Another generally rectangular foot engaging member 124B is secured to end 122B of the transverse bar member 122 and a pair of lip members 128-128 are secured to the transverse bar member on opposed ends 126A–126B of the tube member 126 to prevent transverse movement of the transverse bar member 122 therethrough. The foot engaging members 124A–124B are of dimensions such that same may be slidably and/or telescopically received by the foot members 34-34 of the front crossbar member 30 for elevating the front portion of the apparatus 10. Another setscrew/aperture combination 86/88 is disposed in each of the front crossbar 30 foot members 34-34 for securing the foot engaging members 124A–124B therein. Setscrews 86LA–86LB are respectively received by apertures 88LA–88LB disposed in the front crossbar 30 foot members 34-34. Once the lobbing mechanism is coupled to the front crossbar 30, the angular disposition of the apparatus 10 may be changed for varying the arc of the ball 26 pitched thereby by altering the height of the second tube 114 relative to the first tube 112 of the lobbing mechanism 110. The transverse bar member 122 of the lobbing mechanism 110 is designed to rotate about tube 126 such that the base 120 of the lobbing mechanism 110 does not need to be continually re-staked.

In operation, the apparatus can be easily transported to a ball field in a broken down condition with the fork and trigger mechanism removed from their respective support tubes. The frame 12 is positioned at the desired distance from a home plate and is oriented witch the main frame tube 28 aligned with the center of home plate. The coupling member 84 is then installed on the elongated tube member 28 and setscrew **86*a* (see FIG. 8) is installed in aperture 88*a* and tightened to secure the coupling member 84 to the elongated tube member 28. The rear support tube 52 is installed on the tube member 29 and fixed thereto with setscrew 86 being installed in aperture 88 of the short tube member 90 thereof. Tube member 29 is then installed in coupling member 29 and setscrew 86 is installed in the other aperture 88 of the coupling member and tightened, thereby coupling the rear portion 16 of the apparatus 10 to the front portion 14. The frame is then securely anchored to the ground by driving in stakes 36. If the terrain is uneven, the design of the frame 12 allows the front crossbar member 30 to be rotated along elongated tube 28 relative to tube member 29 such that the rear crossbar member 32 is not rigidly aligned with front crossbar member 30. Alternatively, if the apparatus is to be used indoors, bolt members may be installed in any of the apertures 33-33-33-33 thereof for securing the apparatus to the floor. If the lobbing mechanism 110 is to be used, foot engaging members 124A–124B are installed into the front crossbar 30 foot members 34-34 and setscrew/aperture combinations 86LA/88LA–86LB/88LB are utilized to secure the lobbing mechanism 110 thereto. The foot members 118-118 of the lobbing mechanism are then engaged to the ground and the second tube member 114 is adjusted relative to the first tube member 112. The fork 18 and trigger mechanism 20 are installed and vertically adjusted to accommodate the strike zone of the particular size of batters who are to be pitched to by installing setscrews 86-86 into apertures 88-88 of the support post 38 and the upright post 50. The ball retention arms 60-62 are then held together and inside edges 74A–74A of trigger 74 are engaged to the support members 67-67 of the ball retention arms 60-62 after spring 72T of the trigger member 74 biases the trigger member 74 downward. Ball 26 is placed in the pouch 22 and the tension members 24-24 are stretched such that the ball 26 and pouch 22 combination may be slidably disposed between the ball retention members 60-62, as shown in FIG. 5 and/or FIG. 1, thereby "cocking" the apparatus as shown in FIG. 4. Alternatively, the ball and pouch combination 22 and 26 is stretched and held inside the ball retention members 60-62 and the ball retention members 60-62 are subsequently folded inward until the spring 72T of the trigger member 74 pulls inside edges 74A—74A of trigger member 74 therearound to engage the support members 67-67 of the ball retention members 60-62. The ball 26 is pitched or released by pivoting handle 75 downward, thereby releasing the ball retention members 60-62. The ball retention members 60-62 are pulled away from each other by the action of springs 72-72 (see FIG. 8) and ball 26 is propelled forward by the bias of tension members 24-24**.

The apparatus 10 of the invention is inherently safe since it requires no electric or gas motors nor any electric cords. It is so simple to operate that even mothers unfamiliar with it can quickly catch on and use it to pitch to their children. The pouch 22 can be pulled back with two hands to stretch the tensioning surgical tubing 24 sufficiently that a ball can likely be pitched with the apparatus 10 faster than it could otherwise be thrown by the operator. A particular advantage of the pitching apparatus of the invention is that the pitches are accurate once the apparatus is adjusted, but they are not uniform. The apparatus typically throws four strikes out of five pitches but those four strikes are likely to be at different positions in the strike zone. The vertical adjustability of the pouch within the trigger mechanism 20 accounts for some of the variance. The apparatus also tends to throw a few knuckle balls so the batter can expect a wide variety of pitches. Finally, the narrow profile of the apparatus when viewed from the front makes the apparatus a very small target which will be seldom hit by batted balls. Although the apparatus is readily applicable for use in pitching balls 26, it is to be understood that the apparatus may be used for pitching or throwing any variety of objects, such as, given by example only, clay skeet used in target shooting.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A slingshot-type ball pitching apparatus, comprising, an elongated ground support frame having forward and rearward ends, an upright fork, means for mounting said fork adjacent the forward end of said frame, a ball-receiving pouch, a stretchable tension member connecting said pouch to said fork, a spring biased trigger mechanism, means for mounting said trigger mechanism at an elevated position adjacent the rearward end of the frame, said trigger mechanism being operative to releasably hold a ball upon placement of the ball in said pouch and upon stretching of said tension member to pull said pouch and ball rearwardly for engagement by the trigger mechanism, means for length adjustably supporting at least one of said fork and trigger mechanism on said frame thereby to vary the release speed of the ball, means for adjusting the transverse position of at least one of said fork and trigger mechanism relative to said frame thereby to transversely adjust the direction of a ball released by said trigger mechanism, and frame adjusting means for adjusting a frame length of said elongated ground support frame.

2. The pitching apparatus of claim 1 further comprising means for vertically adjusting one of said fork and trigger mechanism relative to said frame.

3. The pitching apparatus of claim 2 further comprising means for vertically adjusting the other of said fork and trigger mechanism relative to said frame.

4. The pitching apparatus of claim 2 wherein said means for vertically adjusting one of said fork and trigger mechanism comprises a telescopic tube structure and means for adjustably fixing the length thereof.

5. The pitching apparatus of claim 3 wherein said means for vertically adjusting the other of said fork and trigger mechanism comprises a telescoping tube structure and means for adjustably adjusting the length thereof.

6. The pitching apparatus of claim 4 wherein said means for adjustably fixing the length of said telescoping tube structure comprises a setscrew.

7. The pitching apparatus of claim 5 wherein said means for adjustably fixing the length of said telescoping tube structure comprises a setscrew.

8. The pitching apparatus of claim 1 wherein said means for adjusting the transverse position of at least one of said fork and trigger mechanism comprises means for transversely rotating said one of said fork and trigger mechanism about a longitudinal axis through said frame.

9. The pitching apparatus of claim 4 wherein said means for adjusting the transverse position of at least one of said fork and trigger mechanism comprises means for transversely rotating said telescoping tube structure about a longitudinal axis through said frame.

10. The pitching apparatus of claim 1 wherein said frame includes an elongated main tube substantially spanning the length of the frame and said means for length adjustably supporting at least one of said fork and trigger mechanism includes a second tube telescopically slidably supported on said main tube, said one of said fork and trigger mechanism being supported on said second tube for longitudinal movement therewith, and means for releasably securing said second tube at selected longitudinal positions relative to said main tube.

11. The pitching apparatus of claim 10 wherein said means for releasably securing said second tube comprises a setscrew.

12. The pitching apparatus of claim 1 further comprising anchor means for releasably anchoring said frame to the ground.

13. The pitching apparatus of claim 1 further comprising a lobbing mechanism that supports a forward end of said frame, said lobbing mechanism having means for adjusting the height of the lobbing mechanism to thereby adjust the height of the forward end of said frame.

14. The pitching apparatus of claim 1 wherein said trigger mechanism comprises a pair of ball retention arms having free ends movable toward and away from one another, biasing means urging said free ends away from one another, and a trigger movable between working and release positions and engageable with said ball retention arms, in the working position thereof, upon movement of said arms toward one another against the urging of said biasing means, to secure said free ends of said arms in adjacent relation for releasably holding said ball and pouch therebetween.

15. The pitching apparatus of claim 14 wherein said trigger comprises a U-shaped member having a pair of spaced apart legs, each releasably engaging a respective one of said ball retention arms.

16. The pitching apparatus of claim 14 wherein the free ends of said ball retention arms terminate in upright ball retention members whereby a ball and pouch retained between said ball retention members is vertically adjustable relative to said ball retention members for limited vertical variance of the direction of a ball released by said trigger mechanism.

17. The pitching apparatus of claim 1 wherein said fork comprises a pair of bifurcated upright members; said bifurcated upright members comprising a space therebetween; and said space comprising a measure of greater than one foot.

18. The pitching apparatus of claim 1 wherein said trigger mechanism comprises a spring member; said spring member having a first end and a second end; said first end of said spring being secured to said trigger mechanism; and said second end of said spring being secured to said rearward end of said frame, and said lobbing mechanism comprises a first tube member and a second tube member; said second tube member being telescopically disposed in said first tube member; said first tube member having a threaded aperture disposed therein for receiving a setscrew; said second tube member being releasably fixed to said first tube member by said threaded aperture receiving said setscrew and said setscrew engaging said second tube; said first tube comprising a first horizontal tube member secured thereto; said first horizontal tube comprising a pair of opposed ends terminating in vertical ground spikes thereof; said second tube comprising a second horizontal tube secured thereto; said second horizontal tube comprising a third horizontal tube concentrically disposed therein; and said third horizontal tube comprising a pair of opposed ends terminating in vertical tube members thereof.

19. A method for throwing an object comprising the steps of:

(a) providing a slingshot-type pitching apparatus comprising an elongated ground support frame having forward and rearward ends thereof, an upright fork, a fork mounting means for mounting said fork adjacent said forward end of said frame, an object-receiving flexible pouch, a stretchable tension member connecting said pouch to said fork, a trigger mechanism, a trigger mounting means for mounting said trigger mechanism at an elevated position adjacent the rearward end of the frame, said trigger mechanism being operative to releasably hold an object upon placement of said object in said flexible pouch and upon stretching of said tension member to pull said flexible pouch and said object contained therein rearwardly for engagement by said trigger mechanism, a length adjusting means for length adjustably supporting at least one of said fork and trigger mechanism on said frame thereby to vary the release speed of the ball, a transverse adjusting means for adjusting a transverse position of at least one of said fork and said trigger mechanism relative to said frame thereby to transversely adjust the direction of a ball released by said trigger mechanism, and a frame adjusting means for adjusting a distance between said fork and said trigger mechanism;

(b) installing said apparatus on a surface;

(c) placing an object in said flexible pouch at a desired position to set the type of pitch to be thrown;

(d) stretching said tension member by moving said pouch and said object contained therein rearwardly;

(e) engaging said pouch and said object contained therein with said trigger mechanism; and (f) releasing said trigger mechanism to throw said object.

20. The method of claim 19 wherein said providing step (a) additionally comprises said slingshot-type pitching apparatus having said trigger mechanism comprising a pair of object-retention arms for releasably engaging said pouch and said object contained in said pouch, and said fork member comprises a pair of upright arm members having a space therebetween of about 14 inches; additionally comprising adjusting said frame adjusting means prior to said installing step (b); additionally comprising adjusting said length adjusting means prior to said placing step (c); and additionally comprising adjusting said transverse adjusting means prior to said releasing step (f).

* * * * *